US010354817B2

(12) United States Patent
Su et al.

(10) Patent No.: US 10,354,817 B2
(45) Date of Patent: Jul. 16, 2019

(54) KEYBOARD SWITCH WITH GUIDE CORE LIMITING FUNCTION

(71) Applicants: Dongguan City Kaihua Electronics Co., Ltd, Guangdong (CN); Silitek Electronics (Dongguan) Co., Ltd, Guangdong (CN)

(72) Inventors: Chih-Wen Su, Guangdong (CN); Yuang-Feng Hu, Guangdong (CN)

(73) Assignees: DONGGUAN CITY KAIHUA ELECTRONICS CO., LTD, Guangdong (CN); SILITEK ELECTRONICS (DONGGUAN) CO., LTD, Guangdong (CN)

( * ) Notice: Subject to any disclaimer, the term of this patent is extended or adjusted under 35 U.S.C. 154(b) by 0 days.

(21) Appl. No.: 15/942,706

(22) Filed: Apr. 2, 2018

(65) Prior Publication Data

US 2018/0294111 A1 Oct. 11, 2018

(30) Foreign Application Priority Data

Apr. 8, 2017 (CN) ..... 2017 2 0363699 U

(51) Int. Cl.
*H01H 13/14* (2006.01)
*H01H 13/7065* (2006.01)

(52) U.S. Cl.
CPC ..... *H01H 13/14* (2013.01); *H01H 13/7065* (2013.01); *H01H 2221/058* (2013.01); *H01H 2221/064* (2013.01); *H01H 2223/03* (2013.01); *H01H 2223/054* (2013.01); *H01H 2231/008* (2013.01); *H01H 2235/01* (2013.01); *H01H 2235/03* (2013.01)

(58) Field of Classification Search
CPC ..... H01H 3/022; H01H 3/12; H01H 36/004; H01H 11/00; H01H 13/00; H01H 13/14; H01H 2221/00; H01H 2221/044; H01H 2235/018; H01H 2235/03; H01H 2235/004; B41J 5/12; B41J 5/16; B41J 5/28
See application file for complete search history.

(56) References Cited

U.S. PATENT DOCUMENTS 3,183,333 A * 5/1965 Golbeck ..... H01H 9/162 200/314
4,418,257 A 11/1983 Muller et al.

FOREIGN PATENT DOCUMENTS

TW 232413 10/1994

* cited by examiner

*Primary Examiner* — Vanessa Girardi
(74) *Attorney, Agent, or Firm* — McClure, Qualey & Rodack, LLP

(57) ABSTRACT

The invention discloses a keyboard switch including a base, a cover covering the base to form a cavity, an upper guide core disposed in the cavity and an upper guide core limiting mechanism including a lower guide core elastomer, a lower guide core, a middle guide core spring and a middle guide core sequentially disposed on the base. The upper guide core and the middle guide core are connected through an upper guide core spring. The keyboard switch of the invention provides accuracy of the press-conduction displacement, accurate positioning of the conduction course, and adjustability of the press force, such that the press force becomes more balanced, and the keyboard switch is conducted when the guide core is pressed downwards. Thus, the overall press stability of the keyboard switch is improved.

9 Claims, 7 Drawing Sheets

KEYBOARD SWITCH WITH GUIDE CORE LIMITING FUNCTION

This application claims the benefit of People's Republic of China application Serial No. 201720363699.7, filed Apr. 8, 2017, the subject matter of which is incorporated herein by reference.

BACKGROUND OF THE INVENTION

Field of the Invention

The invention relates in general to and a keyboard switch, and more particularly to a keyboard switch with a guide core limiting function.

Description of the Related Art

Many operations of electronic equipment use keyboard switch as an input device. The performance of the keyboard switch greatly affects user's experience with the input device. Therefore, the keyboard switch needs to have good press stability.

However, the keyboard switch still has some problems with the internal structural design. When the keyboard switch is pressed by a downward force, the force may be unbalanced. If the press force is too small, the keyboard switch cannot be conducted. If the press force is too large, the keyboard, particularly the thin-film keyboard, may be damaged, and the normal use of the keyboard switch may be incapacitated. Meanwhile, when the guide core is pressed up and down, the press-conduction course of the keyboard switch is difficult to position, making the pressing operation unsmooth during the use of the keyboard switch, deteriorating the stability, and greatly affecting the normal use of the keyboard switch.

SUMMARY OF THE INVENTION

To resolve the above problems, the invention discloses a keyboard switch capable of providing accuracy of the press-conduction displacement, accurately positioning the conduction course, and adjusting the press force, such that the press force becomes more balanced, the keyboard switch is conducted when the guide core is pressed downwards. Thus, the overall press stability of the keyboard switch is improved.

To achieve the above objects, the invention adopts following technical solutions:

A keyboard switch includes a base, a cover covering the base to form a cavity, an upper guide core disposed in the cavity and an upper guide core limiting mechanism disposed in the cavity and located at a lower end of the upper guide core. The upper guide core limiting mechanism includes a lower guide core elastomer, a lower guide core, a middle guide core spring and a middle guide core sequentially disposed on the base. The upper guide core and the middle guide core are connected through an upper guide core spring.

As an inventive step of the invention, the cavity is formed by an upper recess formed on an upper end surface of the base and a lower recess formed on a lower end surface of the cover.

As an inventive step of the invention, a base port is formed on an inner bottom of the upper recess of the base; and a base column is protruded from an edge of the base port; the lower guide core includes a lower guide column inserted into the base port and an upper guide column connected to the lower guide column having a lower slot formed on the central axial direction, an upper slot connected to the lower slot is formed on the central axial direction of the upper guide column, the lower guide core elastomer is mounted on the outer sides of the base column and the lower guide column; the middle guide core includes a lower guide portion inserted into the lower slot, and an upper guide portion connected to the lower guide portion and received in the upper slot; a guide port is formed on the central axial direction of the lower guide portion, an upper guide core spring activity slot connected to the guide port is formed on the central axial direction of the upper guide portion, the middle guide core spring is mounted on the outer side of the lower guide portion; the lower end of the upper guide core has a guide pin inserted into the guide port, the upper guide core spring is mounted on the outer side of the guide pin, and the lower end of the upper guide core spring is located in the upper guide core spring activity slot.

As an inventive step of the invention, the upper guide core includes an upper guide core guide plate, a press portion disposed on the upper guide core guide plate and passing through an upper end of the cover, and an upper guide core guide block disposed on two lateral sides of the upper guide core guide plate and extended downwards; the guide pin is disposed at a lower end of the upper guide core guide plate, and a space for receiving the middle guide core and the lower guide core is reserved between the upper guide core guide block and the guide pin respectively formed on two lateral sides of the upper guide core guide plate.

As an inventive step of the invention, a lower guide core annular recess for receiving the upper end of the lower guide core elastomer is formed on a lower end surface of the upper guide column of the lower guide core and located at the periphery of the lower guide column.

As an inventive step of the invention, a middle guide core lower annular recess for receiving the upper end of the middle guide core spring is formed on a lower end surface of the upper guide portion of the middle guide core and located at the periphery of the lower guide portion; a middle guide core upper annular recess for receiving the lower end of the upper guide core spring is formed at the edge of the inner bottom of the upper guide core spring activity slot of the upper guide portion of the middle guide core.

As an inventive step of the invention, an upper guide core annular recess for receiving the upper end of the upper guide core spring is formed on a lower end surface of the upper guide core guide plate and located at the periphery of the guide pin.

As an inventive step of the invention, the lower end of the lower recess of the cover is protruded downwards to form an upper guide core guide portion, and a guide recess for receiving the guide core guide block is formed on the upper guide core guide portion.

As an inventive step of the invention, the upper guide core comprises a press block having a press protrusion, and the press block is formed on a lateral side of the upper guide core; a torsion spring is disposed in the base and above the press block of the upper guide core and has a press point under the press protrusion.

As an inventive step of the invention, the lower guide core elastomer is formed of any one of spring, silicone and elastic piece.

The invention provides following effects:

(1) With the configuration of an upper guide core limiting mechanism formed of a middle guide core, a middle guide core spring, a lower guide core and a lower guide core elastomer, accuracy of the press-conduction displacement, and coordination, controllability and adjustability of the press force can be achieved, such that the press force is made more balanced, and various adjustments of coordination are made according to the length of each spring and the amount of the press force. Thus, the keyboard switch will be conducted when the guide core is pressed downwards, the conduction of the keyboard switch will not fail when the press force is too large or too small, the thin-film keyboard will not be damaged even when the press force is too large, and the overall press stability of the keyboard switch is improved.

(2) The keyboard switch of the invention provides relatively accurate positioning of the press-conduction course and is particularly applicable to the thin-film keyboard switch. The keyboard switch of the invention is highly applicable to the thickness of the thin film, and can be conducted in each operation under all possible changes in film thickness.

(3) The keyboard switch of the invention combines three springs including an upper guide core spring, a middle guide core spring and a lower guide core elastomer to achieve better stage-wise press operation.

(4) With the combination of the middle guide core and the lower guide core, the upper slot of the lower guide core facilitates positioning during the press-conduction course to increase press stability.

(5) With the upper guide core spring having a larger elasticity being used as a press spring that matches the upper guide core, the press pressure is increased, the amount of the press-conduction force is adjustable, the press-conduction can be achieved without causing damage to the thin-film keyboard, and the manual press operation can be enhanced.

(6) With the upper guide core spring, the middle guide core spring, and the lower guide core elastomer being used in conjunction with the torsion spring, the lifespan of the keyboard switch of the invention is prolonged, the elasticity center is coaxial, and the stability is increased.

(7) With the torsion spring being used in conjunction with the press block of the upper guide core, the press protrusion of the press block hits the press point of the torsion spring during the press process and produces a very good sound effect. With the torsion spring being used as a sounding element, the lifespan can be greatly increased.

(8) The upper guide core; the middle guide core and the lower guide core have smaller volumes. The base and the cover both are transparent and light permeable, and therefore generate very good light-emitting effect.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
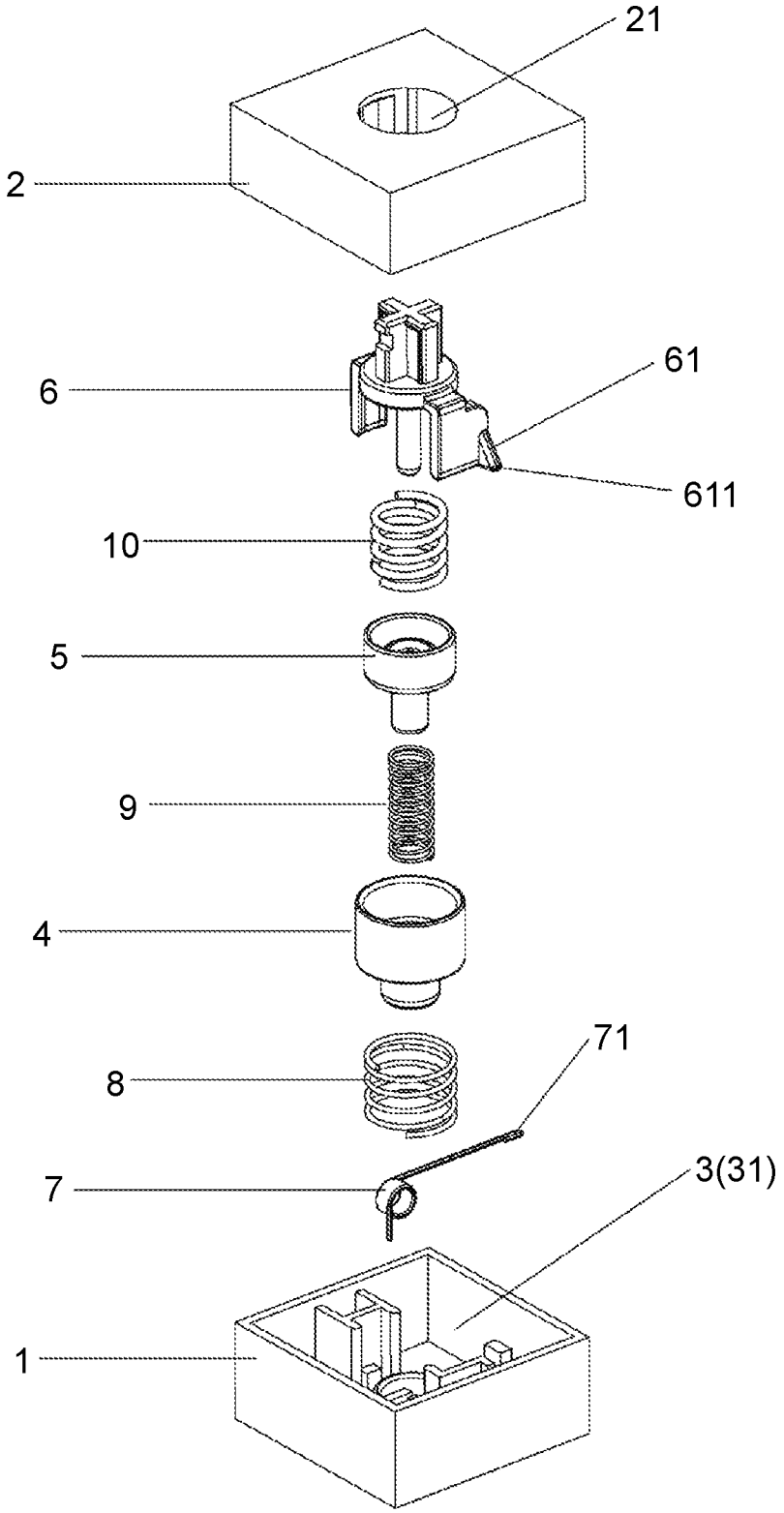
FIG. 1 is an explosion diagram of a keyboard switch of the invention.
Figure 2:
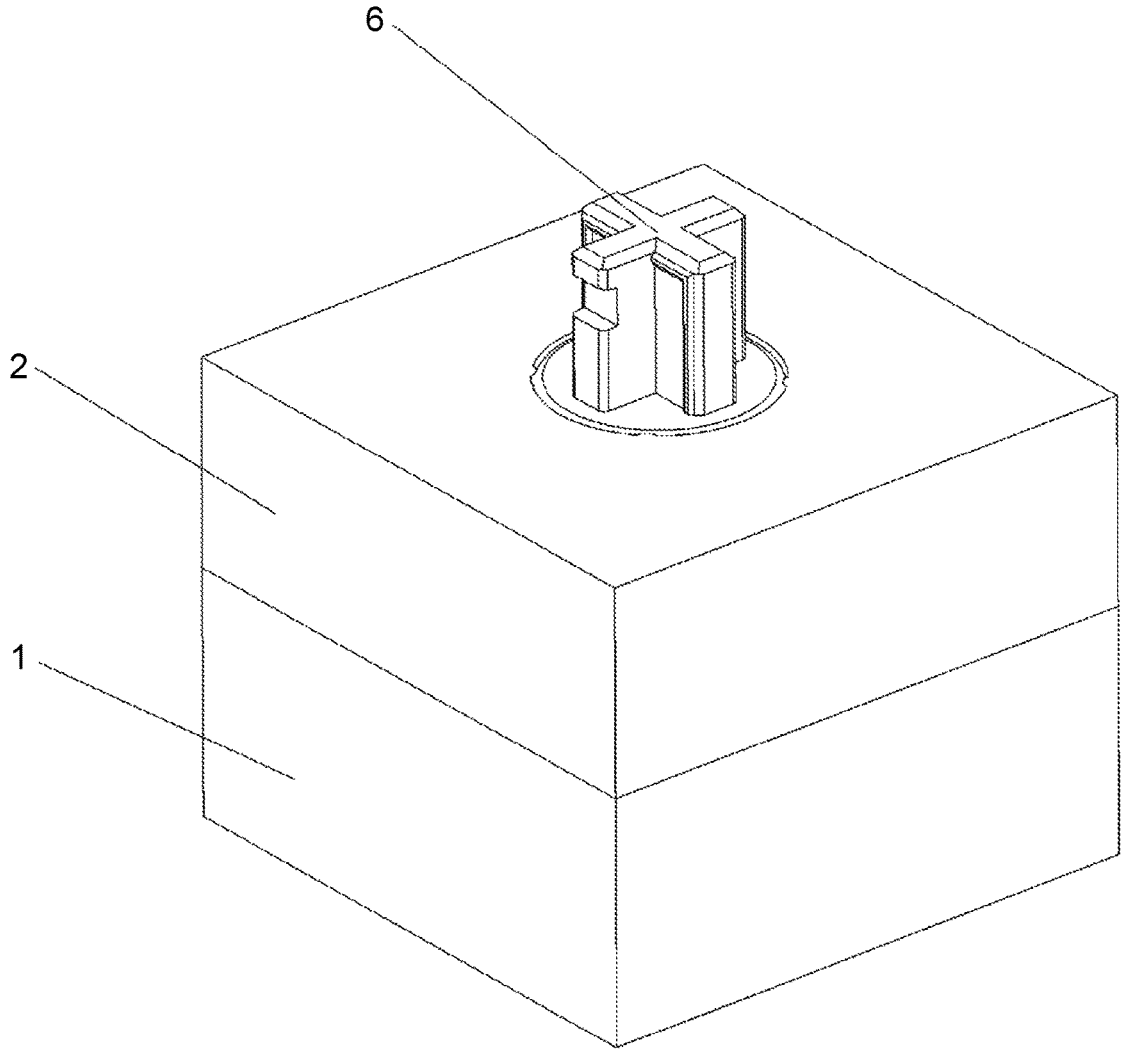
FIG. 2 is an external view of a keyboard switch of the invention.

For the technical solutions adopted in the invention to achieve predetermined objects and effects to be more clearly understood, detailed descriptions of the invention are disclosed below with accompanying drawings and exemplary embodiments.

Refer to FIG. 1 to FIG. 10. A keyboard switch with a guide core limiting function including a base 1 and a cover 2 having an upper opening 21 is provided, wherein the cover 2 covers the base 1 to form a cavity 3, and a conducting assembly and an upper guide core 6 disposed in the cavity 3. The conducting assembly includes a static contact pad and a dynamic contact pad. The keyboard switch further includes an upper guide core limiting mechanism disposed in the cavity 3 and located at a lower end of the upper guide core 6. The upper guide core limiting mechanism includes a lower guide core elastomer 8, a lower guide core 4, a middle guide core spring 9 and a middle guide core 5 sequentially disposed on the base 1 in a bottom-up manner. The upper guide core 6 and the middle guide core 5 are connected through an upper guide core spring 10.

In the present embodiment, the cavity 3 is mainly formed by an upper recess 31 formed on the upper end surface of the base 1 and a lower recess 32 formed on the lower end surface of the cover 2.

As indicated in FIG. 3 to FIG. 10, a base port 11 is formed on an inner bottom of the upper recess 31 of the base 1, and a base column 12 is protruded from an edge of the base port 11. The lower guide core 4 includes a lower guide column 41 inserted into the base port 11 by way of upward/downward movements and an upper guide column 42 connected to the lower guide column 41 having a lower slot 411 formed on central axial direction. An upper slot 421 connected to the lower slot 411 is formed on the central axial direction of the upper guide column 42. The lower guide core elastomer 8 is mounted on outer sides of the base column 12 and the lower guide column 41 and is used as a restore spring when the lower guide core 4 is pressed downwards. The middle guide core 5 includes a lower guide portion 51 inserted into the lower slot 411 by way of upward/downward movements, and an upper guide portion 52 connected to the lower guide portion 51 and received in the upper slot 421 by way of upward/downward movements. A guide port 511 is formed on the central axial direction of the lower guide portion 51. An upper guide core spring activity slot 521 connected to the guide port 511 is formed on the central axial direction of the upper guide portion 52. The middle guide core spring 9 is mounted on the outer side of the lower guide portion 51 and is used as a restore spring when the middle guide core 5 is pressed downwards. The lower end of the upper guide core 6 has a guide pin 65 inserted into guide port 511 by way of upward/downward movements. The upper guide core spring 10 is mounted on the outer side of the guide pin 65. The lower end of the upper guide core spring 10 is located in the upper guide core spring activity slot 521.

Meanwhile, the upper guide core 6 includes an upper guide core guide plate 62, a press portion 63 disposed on the upper guide core guide plate 62 and passing through an upper end of the cover 2, and an upper guide core guide block 64 disposed on two lateral sides of the upper guide core guide plate 62 and extended downwards. A space for receiving the middle guide core 5 and the lower guide core 4 is reserved between the upper guide core guide block 64 and the guide pin 65 respectively formed on two lateral sides of the upper guide core guide plate 62.

Figure 3:
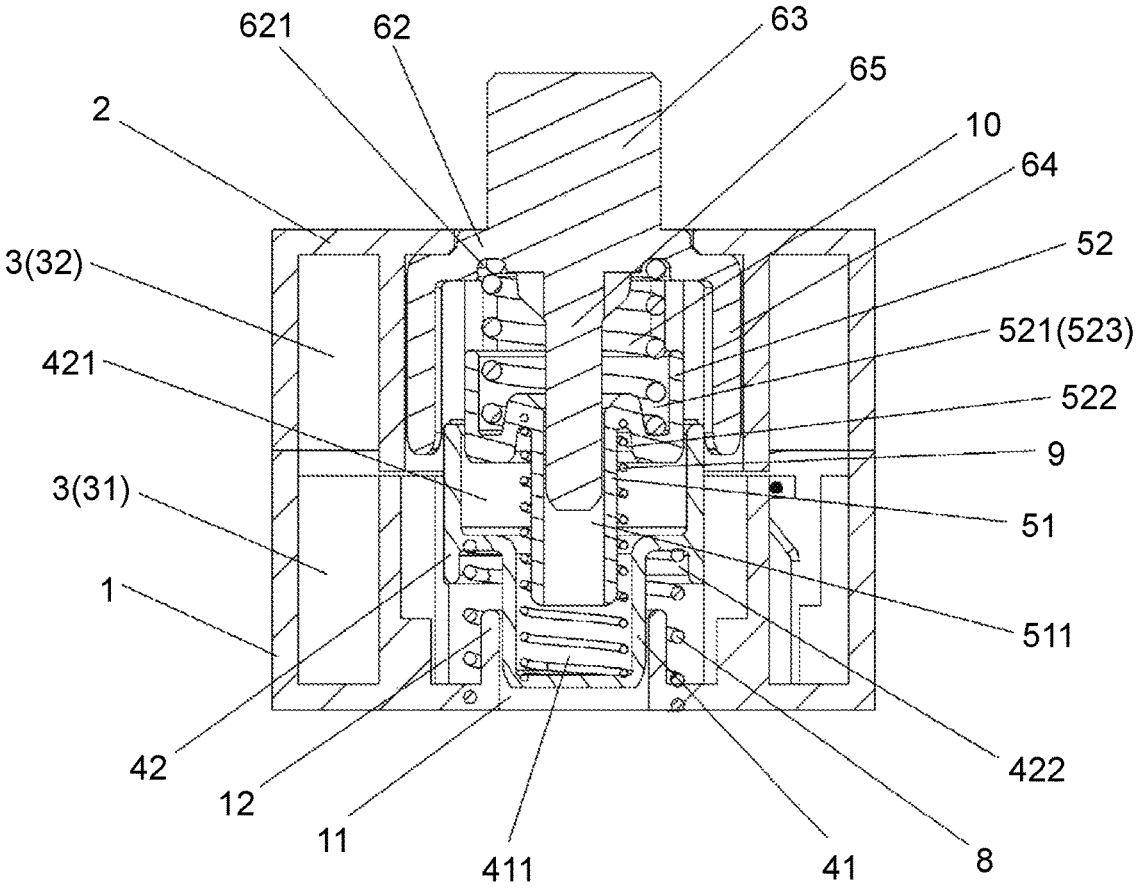
FIG. 3 is a cross-sectional view of a keyboard switch of the invention.
Figure 10:
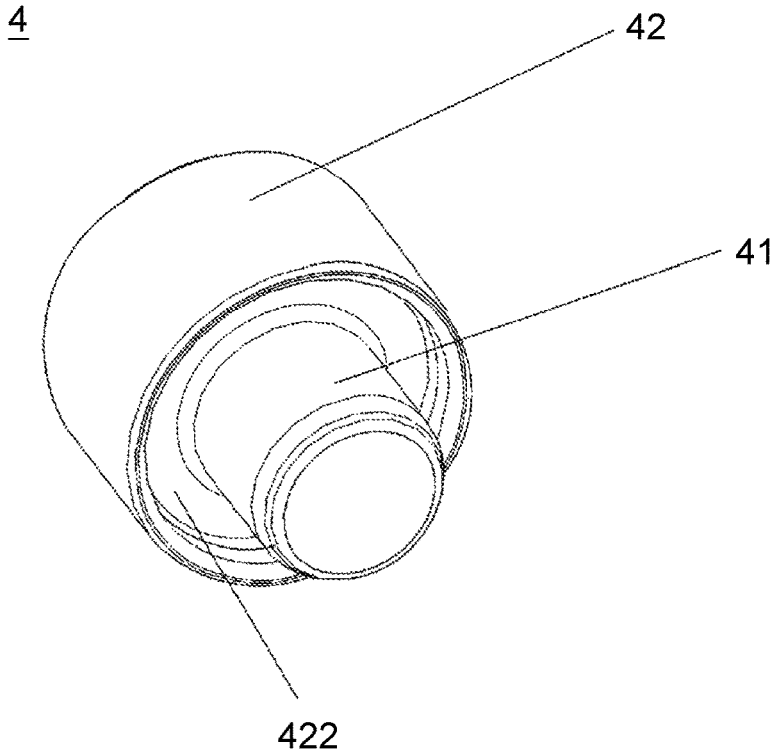
FIG. 10 is another structure diagram of a lower guide core of a keyboard switch of the invention.

As indicated in FIG. 3 and FIG. 10, a lower guide core annular recess 422 for receiving the upper end of the lower guide core elastomer 8 is formed on a lower end surface of the upper guide column 42 of the lower guide core 4 and located at the periphery of the lower guide column 41.

Figure 8:
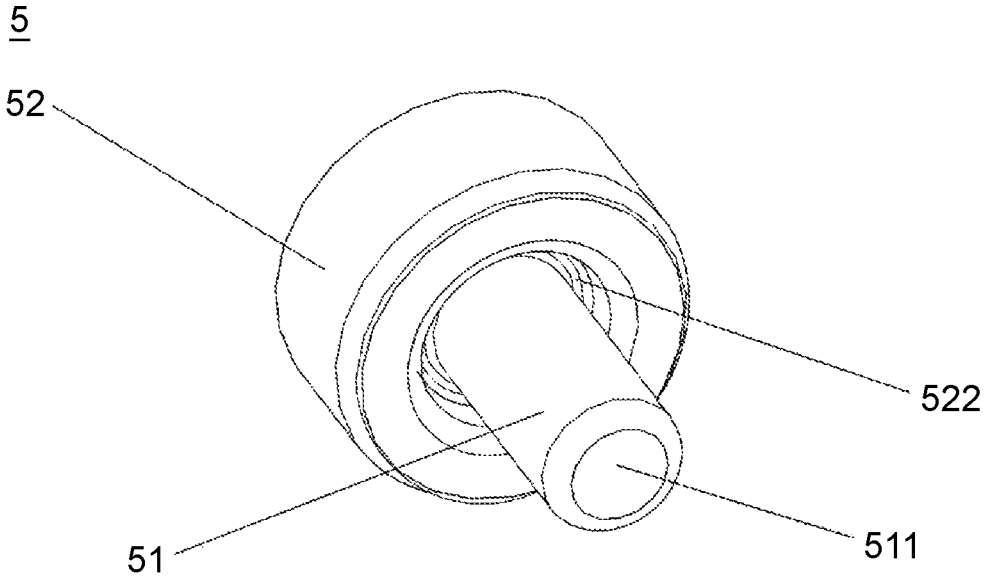
FIG. 8 is another structure diagram of a middle guide core of a keyboard switch of the invention.
Figure 9:
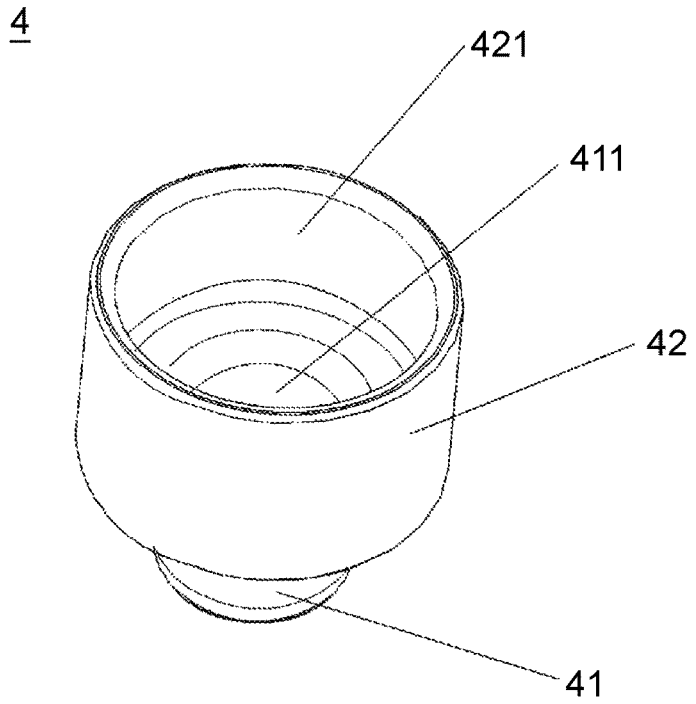
FIG. 9 is a structure diagram of a lower guide core of a keyboard switch of the invention.

As indicated in FIG. 3 and FIG. 8, a middle guide core lower annular recess 522 for receiving the upper end of the middle guide core spring 9 is formed on a lower end surface of the upper guide portion 52 of the middle guide core 5 and located at the periphery of the lower guide portion 51.

Figure 7:
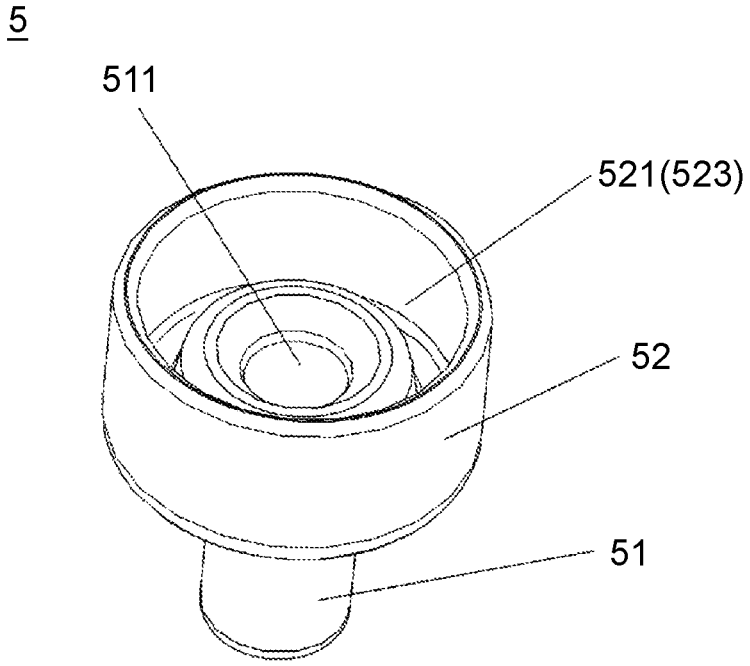
FIG. 7 is a structure diagram of a middle guide core of a keyboard switch of the invention.

As indicated in FIG. 3 and FIG. 7, a middle guide core upper annular recess 523 for receiving the lower end of the upper guide core spring 10 is formed at the edge of the inner bottom of the upper guide core spring activity slot 521 of the upper guide portion 52 of the middle guide core 5.

As indicated in FIG. 3, an upper guide core annular recess 621 for receiving the upper end of the upper guide core spring 10 is formed on a lower end surface of the upper guide core guide plate 62 and located at the periphery of the guide pin 65.

Figure 5:
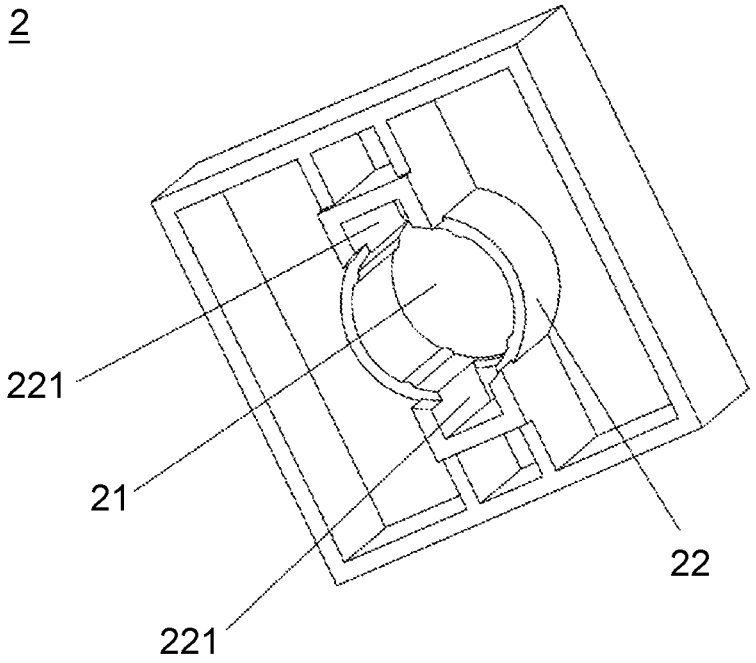
FIG. 5 is a structure diagram of a cover of a keyboard switch of the invention.
Figure 6:
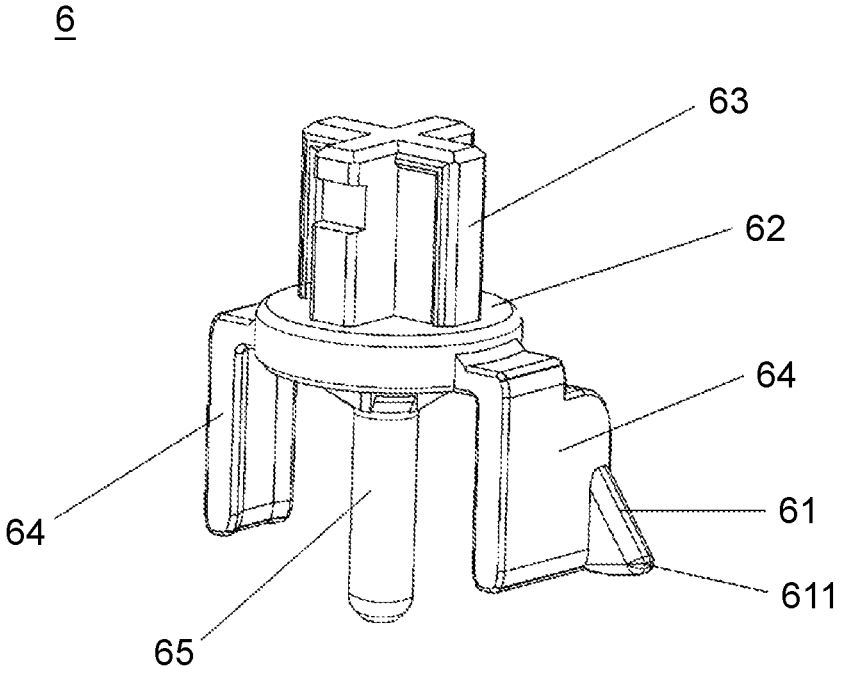
FIG. 6 is a structure diagram of an upper guide core of a keyboard switch of the invention.

As indicated in FIG. 5, the lower end of the lower recess 32 of the cover 2 is protruded downwards to form an upper guide core guide portion 22, and a guide recess 221 for receiving the guide core guide block 64 is formed on the upper guide core guide portion 22.

Figure 4:
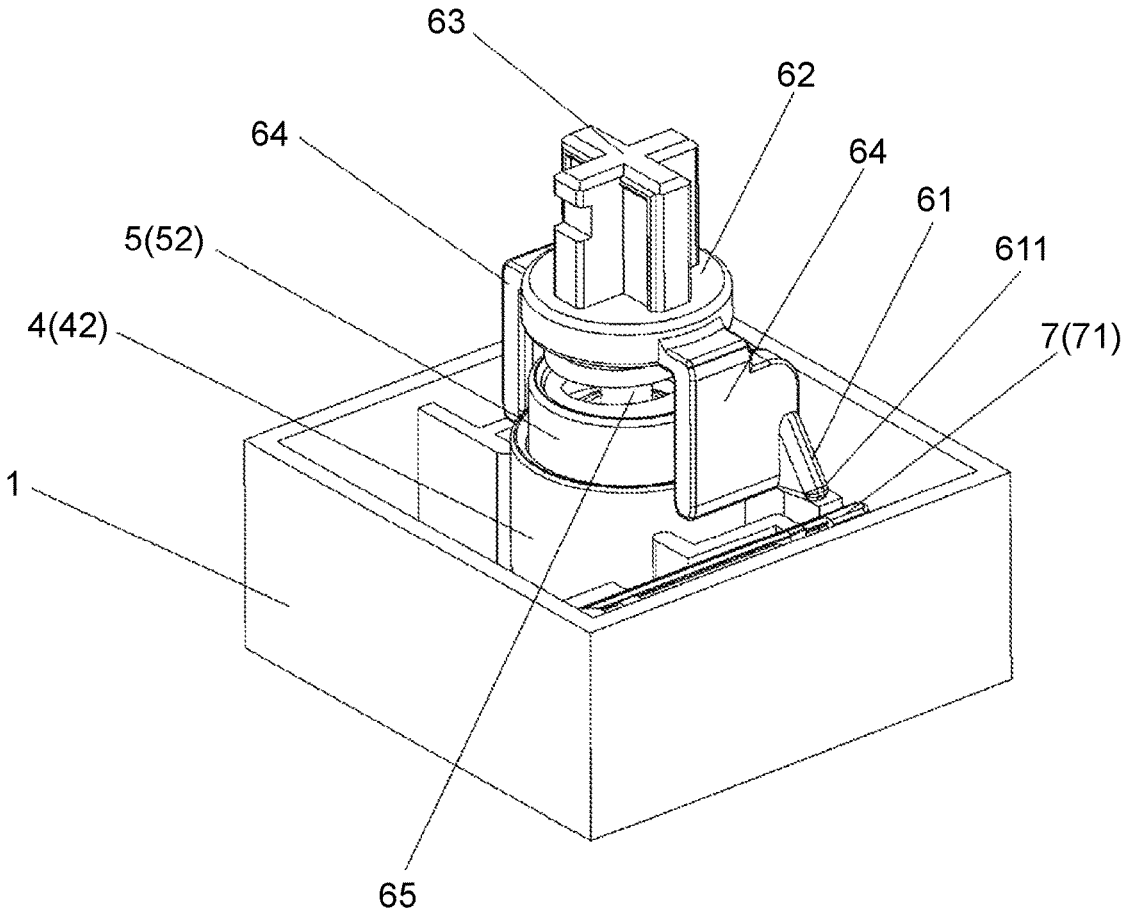
FIG. 4 is a partial structure diagram of a keyboard switch of the invention.

As indicated in FIG. 1 and FIG. 4, a press block 61 having a press protrusion 611 is formed on a lateral side of the upper guide core 6 and integrally forms a triangular shape; a torsion spring 7 is disposed in the base 1 and above the press block 61 of the upper guide core 6 and has a press point 71 right under the press protrusion 611.

With the upper guide core spring 10 having a larger elasticity being used as a press spring that matches the upper guide core 6, the press pressure is increased, the amount of the press-conduction force is adjustable, press-conduction can be achieved without causing damage to the thin-film keyboard, and the manual operation of press can be enhanced.

In the present embodiment, the lower guide core elastomer 8 is formed of any one of spring, silicone and elastic piece.

The principles of operation of the invention are as follows: When the upper guide core 6 is pressed downwards, the upper guide core spring 10 pushes the middle guide core 5, which then compresses the middle guide core spring 9 downwards and moves towards the lower guide core 4. After the middle guide core 5 moves downwards to a certain distance, the lower guide core elastomer 8 is compressed. When the lower guide core 4 contacts an inner bottom of the upper recess 31 of the cavity 3, the upper guide core spring 10 will work. When the force that pressing the upper guide core 6 downwards vanishes, the upper guide core spring 10 will restore first, then the lower guide core elastomer 8 restore, and lastly the middle guide core spring 9 restore.

The keyboard switch of the invention is applicable to various types of keyboard, and particularly the thin-film keyboard.

The invention provides following effects:

(1) With the configuration of an upper guide core limiting mechanism formed of a middle guide core, a middle guide core spring, a lower guide core and a lower guide core elastomer, accuracy of the press-conduction displacement, and coordination, controllability and adjustability of the press force can be achieved, such that the press force is made more balanced, and various adjustments of coordination are made according to the length of each spring and the amount of the press force. Thus, the keyboard switch will be conducted when the guide core is pressed downwards, the conduction of the keyboard switch will not fail when the press force is too large or too small, the thin-film keyboard will not be damaged even when the press force is too large, and the overall press stability of the keyboard switch is improved.

(2) The keyboard switch of the invention provides relatively accurate positioning of the press-conduction course and is particularly applicable to the thin-film keyboard switch. The keyboard switch of the invention is highly applicable to the thickness of the thin film, and can be conducted in each operation under all possible changes in film thickness.

(3) The keyboard switch of the invention combines three springs including an upper guide core spring, a middle guide core spring and a lower guide core elastomer to achieve better stage-wise press operation.

(4) With the combination of the middle guide core and the lower guide core, the upper slot of the lower guide core facilitates positioning during the press-conduction course to increase press stability.

(5) With the upper guide core spring having a larger elasticity being used as a press spring that matches the upper guide core, the press pressure is increased, the amount of the press-conduction force is adjustable, the press-conduction can be achieved without causing damage to the thin-film keyboard, and the manual press operation can be enhanced.

(6) With the upper guide core spring, the middle guide core spring, and the lower guide core elastomer being used in conjunction with the torsion spring, the lifespan of the keyboard switch of the invention is prolonged, the elasticity center is coaxial, and the stability is increased.

(7) With the torsion spring being used in conjunction with the press block of the upper guide core, the press protrusion of the press block hits the press point of the torsion spring during the press process and produces a very good sound effect. With the torsion spring being used as a sounding element, the lifespan can be greatly increased.

(8) The upper guide core, the middle guide core and the lower guide core have smaller volumes. The base and the cover both are transparent and light permeable, and therefore generate very good light-emitting effect.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A keyboard switch, comprising:

a base;

a cover covering the base to form a cavity, an upper guide core disposed in the cavity; and an upper guide core limiting mechanism disposed in the cavity and located at a lower end of the upper guide core, wherein the upper guide core limiting mechanism comprises a lower guide core elastomer, a lower guide core, a middle guide core spring and a middle guide core sequentially disposed on the base, and the upper guide core and the middle guide core are connected through an upper guide core spring, wherein a base port is formed on an inner bottom of the upper recess of the base, and a base column is protruded from an edge of the base port; the lower guide core comprises a lower guide column inserted into the base port and an upper guide column connected to the lower guide column having a lower slot formed on a central axial direction, an upper slot connected to the lower slot is formed on a central axial direction of the upper guide column, the lower guide core elastomer is mounted on outer sides of the base column and the lower guide column.

2. The keyboard switch according to claim 1, wherein the upper guide core comprises a press block having a press protrusion, and the press block is formed on a lateral side of the upper guide core; a torsion spring is disposed in the base and above the press block of the upper guide core and has a press point under the press protrusion.

3. The keyboard switch according to claim 1, wherein the cavity is formed by an upper recess formed on an upper end surface of the base and a lower recess formed on a lower end surface of the cover.

4. The keyboard switch according to claim 3, wherein the middle guide core comprises a lower guide portion inserted into the lower slot, and an upper guide portion connected to the lower guide portion and received in the upper slot; a guide port is formed on the central axial direction of the lower guide portion, an upper guide core spring activity slot connected to the guide port is formed on the central axial direction of the upper guide portion, the middle guide core spring is mounted on an outer side of the lower guide portion; a lower end of the upper guide core has a guide pin inserted into the guide port, the upper guide core spring is mounted on an outer side of the guide pin, and a lower end of the upper guide core spring is located in the upper guide core spring activity slot.

5. The keyboard switch according to claim 4, wherein a lower guide core annular recess for receiving the upper end of the lower guide core elastomer is formed on a lower end surface of the upper guide column of the lower guide core and located at the periphery of the lower guide column.

6. The keyboard switch according to claim 4, wherein a middle guide core lower annular recess for receiving the upper end of the middle guide core spring is formed on a lower end surface of the upper guide portion of the middle guide core and located at the periphery of the lower guide portion; a middle guide core upper annular recess for receiving the lower end of the upper guide core spring is formed at the edge of an inner bottom of the upper guide core spring activity slot of the upper guide portion of the middle guide core.

7. The keyboard switch according to claim 4, wherein the lower end of the lower recess of the cover is protruded downwards to form an upper guide core guide portion, and a guide recess for receiving the guide core guide block is formed on the upper guide core guide portion.

8. The keyboard switch according to claim 4, wherein the upper guide core comprises an upper guide core guide plate, a press portion disposed on the upper guide core guide plate and passing through an upper end of the cover, and an upper guide core guide block disposed on two lateral sides of the upper guide core guide plate and extended downwards; the guide pin is disposed at a lower end of the upper guide core guide plate, and a space for receiving the middle guide core and the lower guide core is reserved between the upper guide core guide block and the guide pin respectively formed on two lateral sides of the upper guide core guide plate.

9. The keyboard switch according to claim 8, wherein an upper guide core annular recess for receiving the upper end of the upper guide core spring is formed on a lower end surface of the upper guide core guide plate and located at the periphery of the guide pin.

* * * * *